US010364709B2

(12) United States Patent
Tanaka et al.

(10) Patent No.: US 10,364,709 B2
(45) Date of Patent: Jul. 30, 2019

(54) VARIABLE VALVE MECHANISM, ENGINE, AND AUTOMATIC TWO-WHEELED VEHICLE

(71) Applicant: SUZUKI MOTOR CORPORATION, Hamamatsu-shi, Shizuoka (JP)

(72) Inventors: Koichi Tanaka, Hamamatsu (JP); Kunio Arase, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 85 days.

(21) Appl. No.: 15/639,562

(22) Filed: Jun. 30, 2017

(65) Prior Publication Data

US 2018/0010487 A1 Jan. 11, 2018

(30) Foreign Application Priority Data

Jul. 5, 2016 (JP) ..... 2016-133288

(51) Int. Cl.

| | |
|---|---|
| ***F01L 1/34*** | (2006.01) |
| ***F01L 1/344*** | (2006.01) |
| ***F01L 1/053*** | (2006.01) |
| *F01L 1/18* | (2006.01) |

(Continued)

(52) U.S. Cl.

CPC ..... *F01L 1/344* (2013.01); *F01L 1/053* (2013.01); *F01L 1/181* (2013.01); *F01L 1/267* (2013.01); *F01L 2001/0473* (2013.01); *F01L 2001/0475* (2013.01); *F01L 2001/0535* (2013.01); *F01L 2105/00* (2013.01); *F01L 2820/035* (2013.01)

(58) Field of Classification Search

CPC ..... F01L 2001/0535; F01L 1/344; F01L 1/34409; F01L 1/34413; F01L 2001/34483; F01L 1/46; F01L 2820/035

USPC ..... 123/90.17, 90.27

See application file for complete search history.

(56) References Cited

U.S. PATENT DOCUMENTS

| | | | | |
|---|---|---|---|---|
| 2,121,560 A * | 6/1938 | Duncan | ..... | F01L 1/34403 123/90.15 |
| 4,577,592 A * | 3/1986 | Bosch | ..... | F01L 1/344 123/90.15 |

(Continued)

FOREIGN PATENT DOCUMENTS

| | | |
|---|---|---|
| CN | 1632292 A | 6/2005 |
| JP | 2011-1882 A | 1/2011 |

OTHER PUBLICATIONS

Chinese Office Action dated May 23, 2019, issued to Chinese Application No. 201710533022.8.

*Primary Examiner* — Jorge L Leon, Jr.
(74) *Attorney, Agent, or Firm* — Stein IP, LLC

(57) ABSTRACT

The present invention is capable of more smoothly changing a phase of a cam shaft in a rotation direction. A variable valve mechanism changes an opening/closing timing of an intake valve or an exhaust valve in response to an engine rotation speed. The variable valve mechanism includes: a cam sprocket which rotates in response to a rotation of a crank shaft; an intake cam shaft which is integrated with an intake cam and is provided to be rotatable relatively to the cam sprocket; and a link member that transmits a rotation from the cam sprocket to the intake cam shaft. The link member is supported by the cam sprocket to be swingable and swings in response to a change in rotation speed of the cam sprocket to rotate the intake cam shaft relatively to the cam sprocket.

13 Claims, 11 Drawing Sheets

(51) Int. Cl.
*F01L 1/26* (2006.01)
*F01L 1/047* (2006.01)

(56) References Cited

U.S. PATENT DOCUMENTS 4,708,101 A * 11/1987 Hara ..... F01L 1/34406
123/90.16
5,179,918 A * 1/1993 Gyurovits ..... F01L 1/344
123/90.17
6,289,860 B1 * 9/2001 Speckhart ..... F01L 1/02
123/90.15
2004/0055548 A1 * 3/2004 Williams ..... F01L 1/022
123/90.15
2009/0240420 A1 * 9/2009 Ishigami ..... F01L 1/022
701/103
2009/0272348 A1 * 11/2009 Yamamoto ..... F01L 1/022
123/90.17
2012/0152194 A1 * 6/2012 Arai ..... F01L 1/146
123/90.15
2012/0279466 A1 * 11/2012 Schober ..... F01L 1/352
123/90.17

* cited by examiner

VARIABLE VALVE MECHANISM, ENGINE, AND AUTOMATIC TWO-WHEELED VEHICLE

INCORPORATION BY REFERENCE

This application is based upon and claims the benefit of priority from the corresponding Japanese Patent Application No. 2016-133288 filed on Jul. 5, 2016, the entire contents of which are incorporated herein by reference.

TECHNICAL FIELD

The present invention relates to a variable valve mechanism, an engine, and an automatic two-wheeled vehicle, and particularly, to a variable valve mechanism which can be applied to a single overhead camshaft (SOHC) type valve train, an engine, and an automatic two-wheeled vehicle.

BACKGROUND ART

Hitherto, as an engine of an automatic two-wheeled vehicle, there is known an engine including a variable valve mechanism changing operation characteristics (including a valve opening/closing timing or a valve lift amount) of an intake valve and an exhaust valve in response to an engine rotation speed (for example, see JP 2011-1882 A). The variable valve mechanism described in JP 2011-1882 A includes a first driven member that is rotatable relatively to a cam shaft by a rotation transmitted from a crank shaft, a second driven member that is rotatable relatively to the first driven member and is relatively displaceable in the axial direction, and a centrifugal weight that is disposed between the first driven member and the second driven member. When the centrifugal weight moves by the action of a centrifugal force so that the second driven member is displaced relatively to the first driven member in the rotation direction, a phase of the cam shaft relatively to the crank shaft in the rotation direction is changed.

SUMMARY OF INVENTION

Technical Problem

However, in the variable valve mechanism described in JP 2011-1882 A, the second driven member is urged toward the first driven member by an urging member while the centrifugal weight is sandwiched between the first driven member and the second driven member. For this reason, since a resistance generated by the operation of the centrifugal weight is large, there is a need to perform a complex fine adjustment of the urging force in consideration of the influence of the resistance in order to smoothly change the phase of the cam shaft in the rotation direction.

The invention has been made in view of the above-described problems and an object of the invention is to provide a variable valve mechanism, an engine, and an automatic two-wheeled vehicle capable of more smoothly changing a phase of a cam shaft in a rotation direction.

Solution to Problem

An aspect of the present invention is summarized as a variable valve mechanism which changes an opening/closing timing of an intake valve or an exhaust valve in response to an engine rotation speed, the variable valve mechanism including: a cam sprocket which rotates in response to a rotation of a crank shaft; a cam shaft which is integrated with any one of intake side and exhaust side cams and is provided to be rotatable relatively to the cam sprocket; and a link member that engages with the cam sprocket and the cam shaft and transmits a rotation from the cam sprocket to the cam shaft, wherein the link member is supported by the cam sprocket to be swingable and swings in response to a change in rotation speed of the cam sprocket to rotate the cam shaft relatively to the cam sprocket.

According to this configuration, the link member swings in accordance with the rotation of the cam sprocket so that the cam shaft rotates relatively to the cam sprocket. For this reason, it is possible to change the phase of the cam shaft in the rotation direction by the swing operation of the link member. Accordingly, it is possible to suppress a resistance during an operation to be low compared to a conventional configuration in which the centrifugal weight is sandwiched between the pair of driven members. As a result, it is possible to more smoothly change the phase of the cam shaft in the rotation direction.

For example, in the above mentioned variable valve mechanism according to the present invention, the link member can include: a swing shaft which is fixed to the cam sprocket; a weight portion which is disposed to be separated from the swing shaft; and an engagement portion which engages with an engagement pin provided in the cam shaft and transmits a rotation of the cam sprocket to the cam shaft; the link member can be supported by the cam sprocket to be swingable; and the weight portion can move outward in the radial direction of the cam sprocket and the engagement portion moves to move the engagement pin in accordance with the rotation of the cam sprocket so that the cam shaft rotates relatively to the cam sprocket. According to this configuration, the weight portion moves outward in the radial direction of the cam sprocket and the engagement portion moves to move the engagement pin in accordance with the rotation of the cam sprocket so that the cam shaft rotates relatively.

Accordingly, it is possible to relatively rotate the cam shaft by swinging the link member using the centrifugal force generated in accordance with the rotation of the cam sprocket. For this reason, it is possible to stably change the phase of the cam shaft in the rotation direction with a simple and easy configuration without requiring a special control mechanism for relatively rotating the cam shaft. Further, since a friction force for the swing shaft is small and the weight portion can be moved even when a change in torque of the engine does not occur, it is possible to easily perform an inspection or an operation check of the cam shaft.

The above mentioned variable valve mechanism according to the present invention can further include: an urging member that is locked to the link member and urges the weight portion inward in the radial direction of the cam sprocket, wherein in a non-swing state of the link member, a distance L1 between a center of the swing shaft and a center of the engagement pin can be smaller than a distance L2 of an imaginary line connecting the center of the swing shaft to a locking position of the urging member on the link member. According to this configuration, since a distance between the swing shaft and the engagement pin is set to be small, it is possible to suppress a rotation moment for swinging the link member to be small when a driving reaction force given from the intake valve (the exhaust valve) to the cam is transmitted to the link member through the cam shaft and the engagement portion. Accordingly, it is possible to prevent a problem in which the link member easily swings.

In the above mentioned variable valve mechanism according to the present invention, in the non-swing state of the link member, an angle α formed by an imaginary line connecting the center of the swing shaft and the center of the engagement pin and a tangential line of a circle using a rotation axis of the cam shaft as a center and passing through the center of the engagement pin can be smaller than an angle β formed by an imaginary line connecting the center of the swing shaft and the locking position of the urging member and a center line of the urging member. According to this configuration, since the angle α is set to be smaller than the angle β, the rotation moment for swinging the link member when the driving reaction force given from the intake valve (the exhaust valve) to the cam is transmitted to the link member through the cam shaft and the engagement portion can be suppressed to be smaller than the rotation moment in which the urging member urges the link member. Accordingly, it is possible to prevent a problem in which the link member easily swings.

In the above mentioned variable valve mechanism according to the present invention, in the non-swing state of the link member, an imaginary line connecting the center of the swing shaft to the center of the engagement pin can intersect at a substantially right angle to an imaginary line connecting the center of the rotation axis of the cam shaft and the center of the engagement pin. According to this configuration, the swing shaft is disposed in the vicinity of the movement direction accompanied by the rotation of the cam shaft, that is, the tangential direction in the non-swing state. For this reason, even when the driving reaction force given from the intake valve (the exhaust valve) to the cam is transmitted to the link member through the cam shaft and the engagement portion, most elements of the driving reaction force can be set as an element for pulling the swing shaft. Accordingly, since the rotation moment for swinging the link member can be suppressed to maximum, it is possible to prevent a problem in which the link member easily swings.

For example, in the above mentioned variable valve mechanism according to the present invention, the engagement portion can be formed as a groove; and the groove can be provided with a first holding position which receives the engagement pin while the link member does not swing to a predetermined position or more and a second holding position which receives the engagement pin while the link member swings to a predetermined position or more and a first stopper portion which protrudes toward a facing inner wall surface of the groove in the vicinity of the first holding position is provided in an inner wall surface disposed at a farther side from the swing shaft in the inner wall surface of the groove. According to this configuration, since the first stopper portion which protrudes toward the facing inner wall surface of the groove in the vicinity of the first holding position is provided in the inner wall surface disposed at a farther side from the swing shaft in the inner wall surface of the groove, the engagement pin received in the first holding position cannot move easily. Accordingly, it is possible to suppress the vibration of the link member even when the driving reaction force given from the intake valve (the exhaust valve) to the cam is transmitted to the link member through the cam shaft and the engagement portion.

In the above mentioned variable valve mechanism according to the present invention, a second stopper portion which protrudes toward a facing inner wall surface of the groove in the vicinity of the second holding position can be provided in the inner wall surface disposed at a close side to the swing shaft in the inner wall surface of the groove. According to this configuration, since the second stopper portion which protrudes toward the facing inner wall surface of the groove in the vicinity of the second holding position is provided in the inner wall surface disposed at a close side to the swing shaft in the inner wall surface of the groove, the engagement pin received in the second holding position cannot move easily. Accordingly, it is possible to suppress the vibration of the link member even when the driving reaction force given from the intake valve (the exhaust valve to the cam is transmitted to the link member through the cam shaft and the engagement portion.

Especially, in the above mentioned variable valve mechanism according to the present invention, the groove can be provided with a substantially S-shaped moving line in which the center of the engagement pin in a front view bypasses the first stopper portion and the second stopper portion. According to this configuration, since the groove is provided with the substantially S-shaped moving line in which the center of the engagement pin bypasses the first stopper portion and the second stopper portion, it is possible to prevent a problem in which the engagement pin received in the first holding position or the second holding position moves easily. Accordingly, it is possible to swing the link member and to return the link member to the non-swing state at a desired timing.

In the above mentioned variable valve mechanism according to the present invention, the urging member can be disposed so that one end thereof is locked to a position near the weight portion in relation to the swing shaft and an angle β interposing the rotation axis of the cam sprocket among angles formed by an imaginary line passing through the locking position of the urging member and the center of the swing shaft and the center line of the urging member becomes an acute angle. According to this configuration, since the angle β which decreases in accordance with an increase in swing angle of the link member is set to an acute angle in advance, it is possible to increase the rotation radius of the weight portion in accordance with an increase in swing angle of the link member and to increase the centrifugal force applied to the weight portion in proportional to the rotation radius. Since the urging force increases as the swing angle of the link member increases in accordance with an increase in rotation speed of the cam sprocket, the link member can be immediately operated. Meanwhile, the link member can be returned to the non-swing state in accordance with a decrease in rotation speed of the cam sprocket. As a result, it is possible to improve the responsiveness of the operation of the link member in response to the rotation speed of the cam sprocket.

For example, in the above mentioned variable valve mechanism according to the present invention, the link member can include a first link member disposed at one side with the rotation axis of the cam sprocket interposed therebetween and a second link member disposed at the other side; and the urging member can include a first urging member disposed at one side with the rotation axis of the cam sprocket interposed therebetween and a second urging member disposed at the other side. According to this configuration, since the first link member and the second link member are disposed at the opposite side with the rotation axis of the cam sprocket interposed therebetween and the first urging member and the second urging member are disposed at the opposite side with the rotation axis of the cam sprocket interposed therebetween, it is possible to dispose the link member and the urging member with a good balance. For this reason, it is possible to keep the smooth rotation of the cam shaft without requiring a weight portion for ensuring a balance.

Especially, in the above mentioned variable valve mechanism according to the present invention, the first link member and the second link member can be disposed to be point-symmetrical to each other with respect to the center of the rotation axis of the cam sprocket and the first urging member and the second urging member are disposed to be point-symmetrical to each other with respect to the center of the rotation axis of the cam sprocket. According to this configuration, since the first link member and the second link member are disposed to be point-symmetrical to each other with respect to the center of the rotation axis of the cam sprocket, it is possible to transmit a rotation force from the cam sprocket through a plurality of link members to be symmetrical each other with respect to the cam shaft. Accordingly, it is possible to smoothly rotate the cam shaft. Further, since the first link member and the second link member are disposed to be point-symmetrical to each other with respect to the center of the rotation axis of the cam sprocket, it is possible to keep the smooth rotation of the cam shaft without requiring a weight portion for ensuring a balance.

In the above mentioned variable valve mechanism according to the present invention, in the first link member and the second link member, the weight portion can be disposed at one side and the engagement portion is disposed at the other side with respect to an imaginary line connecting the center of the swing shaft and the center of the rotation axis of the cam sprocket; one end of the first urging member can be locked to a position near the weight portion in relation to the swing shaft of the first link member and the other end thereof is locked to a position near the engagement portion in relation to the swing shaft of the second link member; and one end of the second urging member can be locked to a position near the weight portion in relation to the swing shaft of the second link member and the other end thereof is locked to a position near the engagement portion in relation to the swing shaft of the first link member. According to this configuration, both the first urging member and the second urging member are locked in the first link member and the second link member. For this reason, when one ends (ends on the side of the weight portion) of the first urging member and the second urging member are pulled outward in the radial direction of the cam sprocket, the other ends (ends on the side of the engagement portion) of the second urging member and the first urging member move inward in the radial direction of the cam sprocket. Accordingly, since the expansion/contraction amounts of the first urging member and the second urging member can be decreased, a burden on the urging member can be reduced. Further, since both ends of the first urging member and the second urging member are locked to the first link member and the second link member, no interference occurs since the urging member is also operated when the link member swings. For this reason, since the first link member and the second link member can be disposed at a close position, the variable valve mechanism can have a simple and compact structure.

In the above mentioned variable valve mechanism according to the present invention, a distance between a locking position of the first urging member at the side of the weight portion in the first link member and the center of the swing shaft of the first link member can be larger than a distance between a locking position of the first urging member at the side of the engagement portion in the second link member and the center of the swing shaft of the second link member; and a distance between a locking position of the second urging member at the side of the weight portion in the second link member and the center of the swing shaft of the second link member can be larger than a distance between a locking position of the second urging member at the side of the engagement portion in the first link member and the center of the swing shaft of the first link member. According to this configuration, even in a structure which pulls both the weight portion and the engagement portion of the plurality of link members, the rotation moment at the weight portion is larger than the rotation moment at the engagement portion and thus both link members can be urged in a non-swing direction. Accordingly, it is possible to stably change the phase of the cam shaft in the rotation direction even when the locking position of the urging member is provided at both the weight portion and the engagement portion in the narrow space.

Further, it is preferable that the engine according to the invention include the variable valve mechanism. According to this configuration, an effect obtained by the variable valve mechanism can be also obtained by the engine.

Further, it is preferable that an automatic two-wheeled vehicle according to the invention include an engine. According to this configuration, an effect obtained by the engine can be also obtained by the automatic two-wheeled vehicle.

According to the invention, it is possible to more smoothly change the phase of the rotation direction of the cam shaft.

BRIEF DESCRIPTION OF THE DRAWINGS

FIG. 6 is a cross-sectional view of the variable valve mechanism illustrated in

FIG. 3;

DESCRIPTION OF EMBODIMENTS

Figure 1:
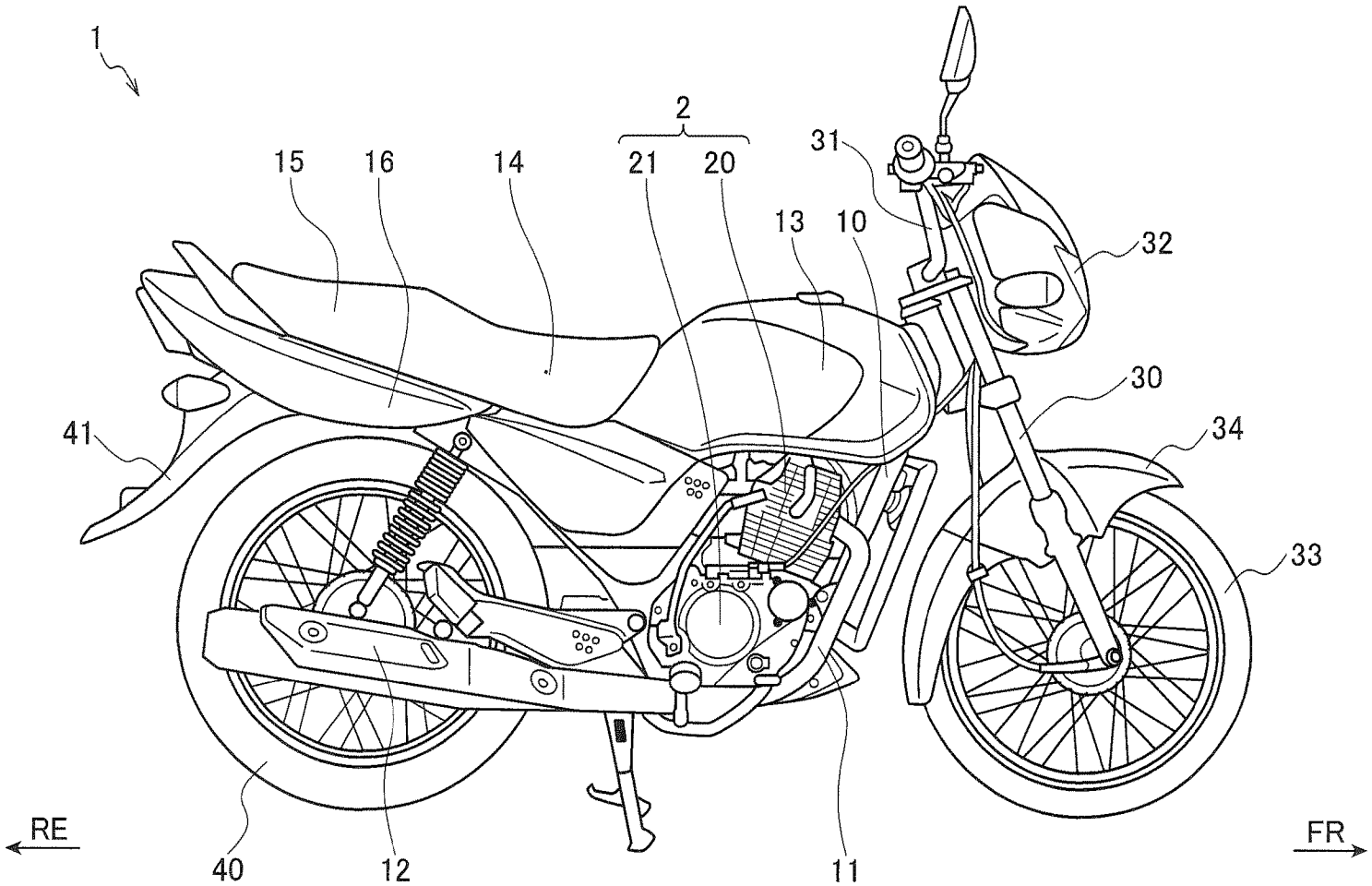
FIG. 1 is a side view illustrating a schematic configuration of an automatic two-wheeled vehicle including an engine that adopts a variable valve mechanism according to an embodiment.

Hereinafter, an embodiment of the invention will be described in detail with reference to the accompanying drawings. Further, in the following description, an example in which a variable valve mechanism according to the invention is applied to an engine of an automatic two-wheeled vehicle will be described, but the application target can be changed without limitation. For example, the variable valve mechanism according to the invention may be also applied to engines of other automatic two-wheeled vehicles, buggy type automatic three-wheeled vehicles, or automatic four-wheeled vehicles. Regarding the direction, the front side of the vehicle will be denoted by an arrow FR, the rear side of the vehicle will be denoted by an arrow RE, the left side of the vehicle will be denoted by L, and the right side of the vehicle will be denoted by an arrow R. Further, in the drawings below, a part of the configuration will be omitted for convenience of the description.

Referring to FIG. 1, a schematic configuration of an automatic two-wheeled vehicle that employs an engine according to the embodiment will be described. FIG. 1 is a side view illustrating a schematic configuration of an automatic two-wheeled vehicle including an engine that employs the variable valve mechanism according to the embodiment.

As illustrated in FIG. 1, an automatic two-wheeled vehicle 1 has a configuration in which an engine 2 is suspended on a vehicle body frame 10 formed of aluminum alloy or a steel product equipped with a power unit, an electricity system, and the like. The engine 2 is, for example, a single cylinder four-cycle engine. The engine 2 has a configuration in which a cylinder assembly 20 (hereinafter, simply referred to as a cylinder 20) obtained by the combination of a cylinder block or a cylinder head is attached to an upper portion of a crank casing 21.

Components such as a piston (not illustrated) or a valve train 5 (see FIG. 2) are received inside the cylinder 20. Although it will be described later in detail, the valve train 5 according to the embodiment is configured as a single overhead camshaft (SOHC) type valve train. Further, various shafts that transmit a rotation of a crank shaft (not illustrated) are received inside the crank casing 21 in addition to the crank shaft.

An exhaust pipe 11 is connected to a front exhaust port of the engine 2. The exhaust pipe 11 extends downward from the exhaust port, is bent under the crank casing 21, and extends toward the rear side of the vehicle body. A muffler 12 is attached to a rear end of the exhaust pipe 11. An exhaust gas which is produced after combustion is discharged to the outside through the exhaust pipe 11 and the muffler 12.

A fuel tank 13 is disposed at an upper portion of the vehicle body frame 10. A driver seat 14 and a passenger seat 15 are disposed at the rear side of the fuel tank 13 along with a rear cowl 16. A pair of left and right front forks 30 are supported by a front head portion of the vehicle body frame 10 to be steerable along with a handlebar 31. A head lamp 32 is provided at the front side of the handlebar 31. A front wheel 33 is supported by a lower portion of the front fork 30 to be steerable and an upper portion of the front wheel 33 is covered by a front fender 34.

A swing arm (not illustrated) is connected to a rear portion of the vehicle body frame 10 to be swingable up and down. A rear wheel 40 is supported by the rear portion of the swing arm to be rotatable. A driven sprocket (not illustrated) is provided at the left side of the rear wheel 40 and power of the engine 2 is transmitted to the rear wheel 40 by a drive chain (not illustrated). An upper portion of the rear wheel 40 is covered by a rear fender 41 provided at a rear portion of the rear cowl 16.

Figure 2:
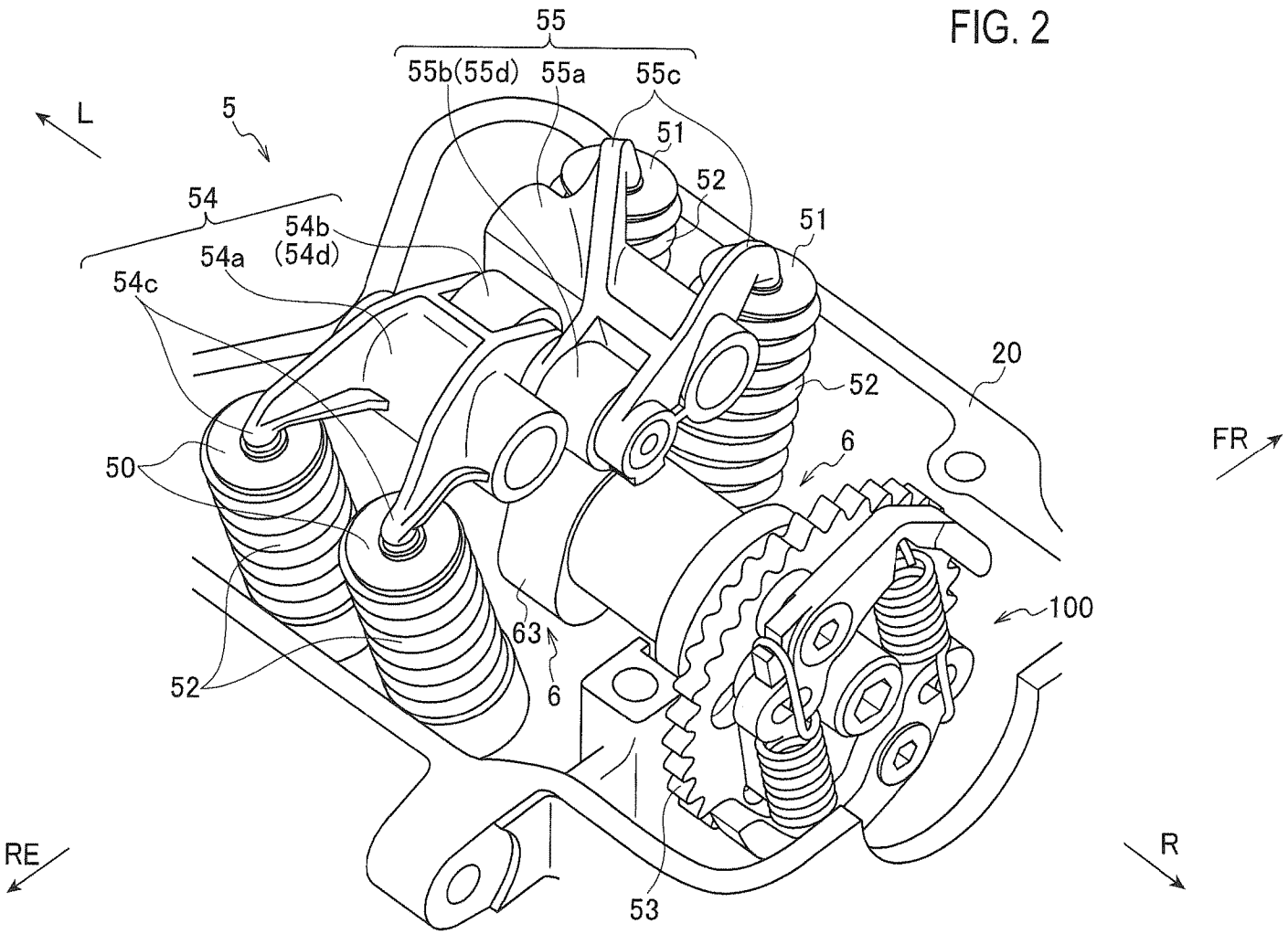
FIG. 2 is a perspective view of a valve train according to the embodiment.
Figure 3:
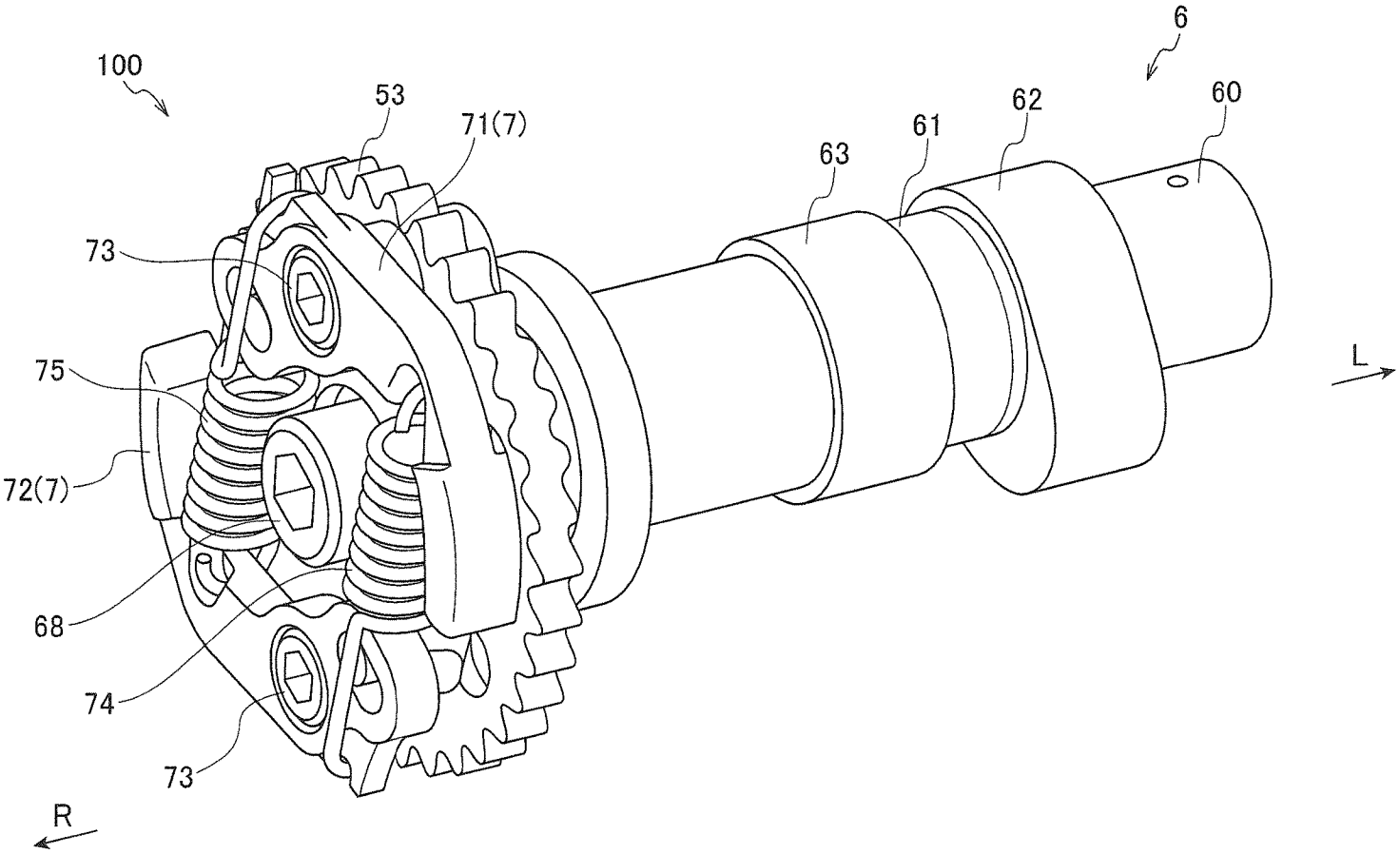
FIG. 3 is a perspective view illustrating a part of the variable valve mechanism that is assembled to the valve train according to the embodiment.

Next, the valve train according to the embodiment will be described with reference to FIGS. 2 and 3. FIG. 2 is a diagram illustrating a state where a cylinder head cover is separated from the engine and is a perspective view of the valve train according to the embodiment. FIG. 3 is a perspective view illustrating a part of a variable valve mechanism that is assembled to the valve train according to the embodiment.

As illustrated in FIG. 2, the valve train 5 which controls the opening/closing of an intake valve 50 and an exhaust valve 51 is provided at an upper portion of the cylinder 20. As described above, the valve train 5 is an SOHC type valve train and has a configuration in which a cam shaft assembly 6 (hereinafter, simply referred to as a cam shaft 6) is disposed above the intake valve 50 and the exhaust valve 51.

Two intake valves 50 are disposed at the cam shaft 6 on the rear side of the vehicle to be arranged in the left and right direction (the vehicle width direction). Further, two exhaust valves 51 are disposed at the cam shaft 6 on the front side of the vehicle to be arranged in the left and right direction. Each of the intake valves 50 and the exhaust valves 51 is provided with a valve spring 52. The intake valves 50 and the exhaust valves 51 are constantly urged upward (in a closing direction) by the valve springs 52.

The cam shaft 6 extends in the left and right direction (see FIG. 3). An intake cam 62 and an exhaust cam 63 are provided at the cam shaft 6 to be arranged in the left and right direction (the intake cam 62 is not illustrated in FIG. 2, but is illustrated in FIG. 3). Specifically, as illustrated in FIGS. 2 and 3, the left side in the axial direction is the intake cam 62 and the right side in the axial direction is the exhaust cam 63. Further, a right end of the cam shaft 6 is provided with a cam sprocket 53. A cam chain (not illustrated) which transmits the rotation of the crank shaft is wound around the cam sprocket 53.

Figure 4:
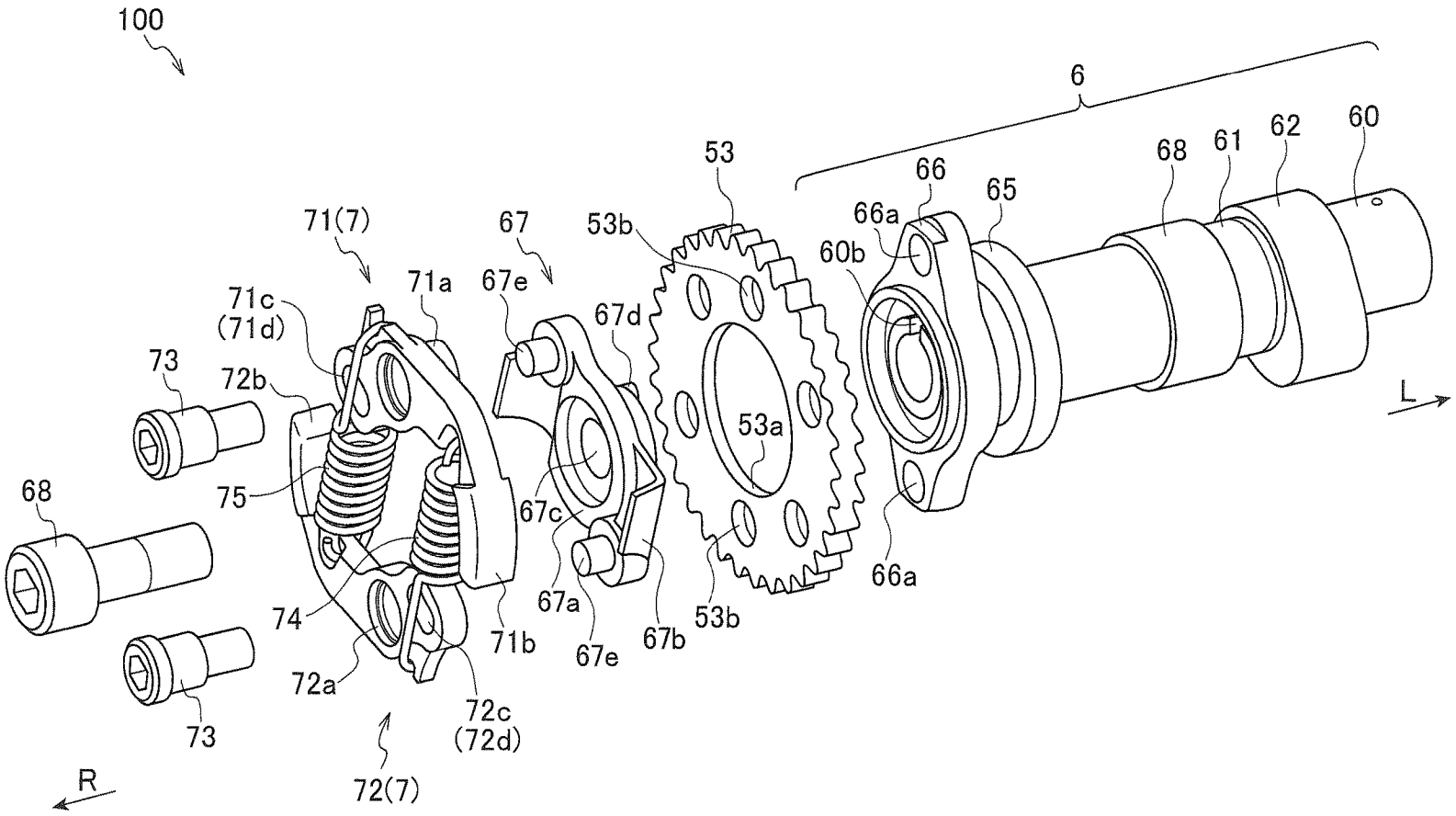
FIG. 4 is an exploded perspective view of the variable valve mechanism illustrated in FIG. 3.
Figure 5:
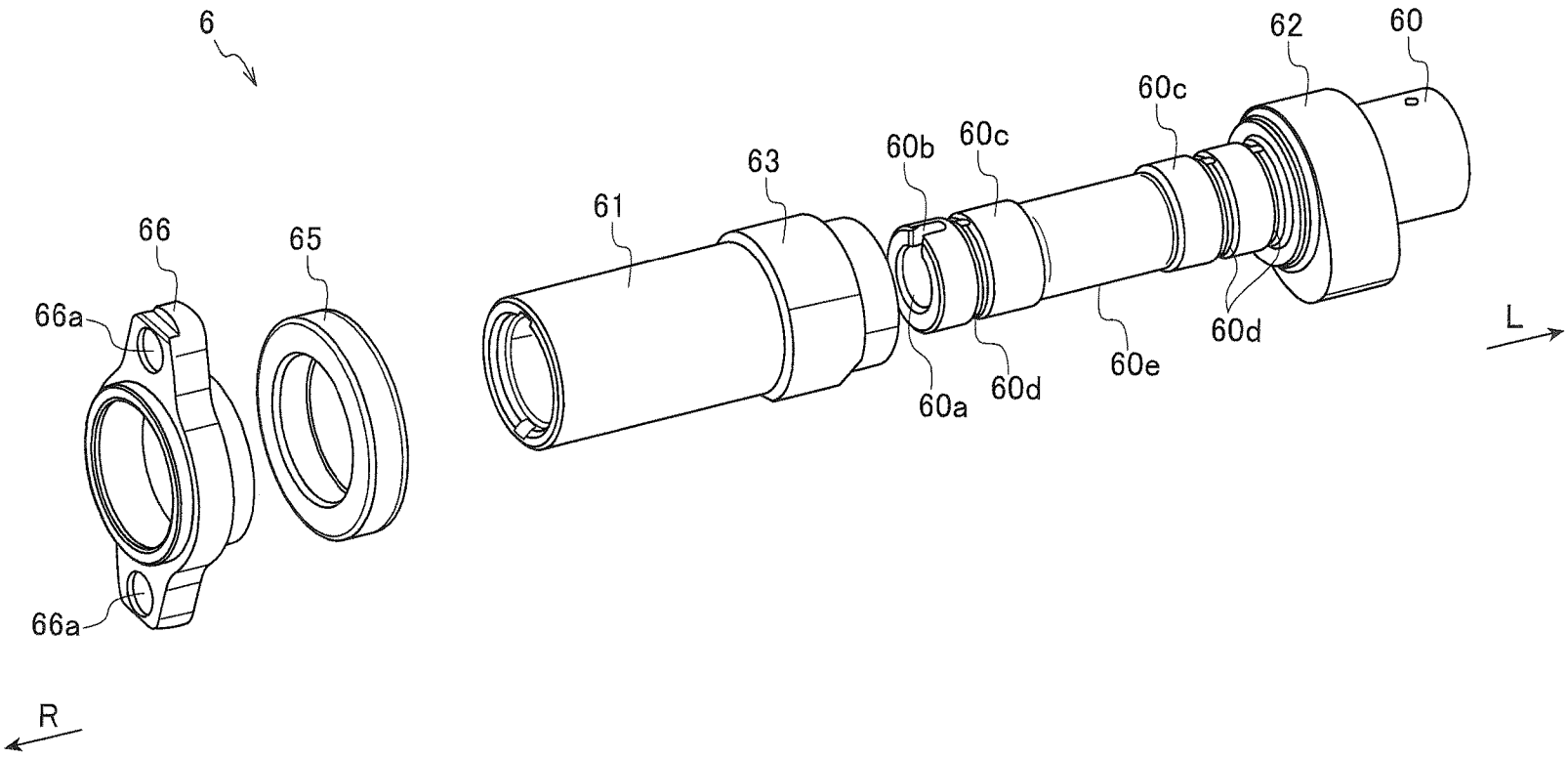
FIG. 5 is an exploded perspective view of a cam shaft assembly according to the embodiment.

For example, the cam shaft 6 is obtained by coaxially assembling an intake cam shaft 60 constituting a first cam shaft and an exhaust cam shaft 61 constituting a second cam shaft (see FIGS. 4 and 5). Although a detailed description will be made below, the cam shaft 6 and the peripheral components thereof constitute a variable valve mechanism 100 which changes the opening/closing timings of the intake valve 50 and the exhaust valve 51.

As illustrated in FIG. 2, an intake rocker arm 54 which opens and closes the intake valve 50 and an exhaust rocker arm 55 which opens and closes the exhaust valve 51 are provided above the cam shaft 6 (the intake cam 62 and the exhaust cam 63). The intake rocker arm 54 is supported to be swingable by an intake rocker shaft (not illustrated) extending in the left and right direction. Specifically, the intake rocker arm 54 includes a support portion **54*a* which serves as a swing support point, a contact portion 54*b* which contacts the intake cam 62, and a pressing portion 54*c* which presses the intake valve 50**.

The support portion **54*a* has a cylindrical shape through which the intake rocker shaft is insertable. The contact portion 54*b* extends forward and downward from the support portion 54*a* and a roller 54*d* is attached to a front end thereof. An outer surface of the roller 54*d* is in contact with an outer surface of the intake cam 62. The pressing portion 54*c* is bifurcated backward and downward from the support portion 54*a* and front ends thereof are in contact with an upper end of the intake valve 50**.

The exhaust rocker arm 55 is also supported to be swingable by an exhaust rocker shaft (not illustrated) extending in the left and right direction. Specifically, the exhaust rocker arm 55 includes a support portion **55*a* which serves as a swing support point, a contact portion 55*b* which contacts the exhaust cam 63, and a pressing portion 55*c* which presses the exhaust valve 51**.

The support portion **55*a* has a cylindrical shape through which the exhaust rocker shaft is insertable. The contact portion 55*b* extends backward and downward from the support portion 55*a* and a roller 55*d* is attached to a front end thereof. An outer surface of the roller 55*d* is in contact with an outer surface of the exhaust cam 63. The pressing portion 55***c* is bifurcated forward and downward from the support portion 55*a* and front ends thereof are in contact with an upper end of the exhaust valve 51.

In the valve train 5 with such a configuration, when the cam shaft 6 rotates along with the rotation of the crank shaft, the contact portion 54*b* (the contact portion 54*b*) slides along a cam surface (the outer surface) of the intake cam 62 (the exhaust cam 63). Especially, the contact portion 54*b* (the contact portion 55*b*) is pressed upward by a protruding portion of the intake cam 62 (the exhaust cam 63). For this reason, the intake rocker arm 54 (the exhaust rocker arm 55) rotates about the support portion 54*a* (the support portion 55*a*) as a support point and the pressing portion 54*c* (the pressing portion 55*c*) moves downward.

At this time, the pressing portion 54*c* (the pressing portion 55*c*) presses the intake valve 50 (the exhaust valve 51) downward (in an opening direction) against an urging force of the valve spring 52. As a result, the intake valve 50 (the exhaust valve 51) is opened. When the contact portion 54*b* (the contact portion 55*b*) gets over the protruding portion of the intake cam 62 (the exhaust cam 63), the intake valve 50 (the exhaust valve 51) is urged upward by the urging force of the valve spring 52. As a result, the intake valve 50 (the exhaust valve 51) is closed. In this way, the opening and closing of the intake valve 50 and the exhaust valve 51 is controlled.

Next, the variable valve mechanism 100 that is assembled to the valve train 5 according to the embodiment will be described with reference to FIGS. 3 and 4. FIG. 4 is an exploded perspective view of the variable valve mechanism 100 illustrated in FIG. 3. Additionally, FIGS. 3 and 4 illustrate a state (a non-swing state) where a pair of link members 7 (a first link member 71 and a second link member 72) constituting the variable valve mechanism 100 do not swing.

As described above, the valve train 5 according to the embodiment (see FIG. 2) includes the variable valve mechanism 100 which changes the opening and closing timing of the intake valve 50 or the exhaust valve 51 (see FIG. 2) in response to an engine rotation speed. As illustrated in FIG. 3, the variable valve mechanism 100 is a so-called governor type variable valve timing mechanism which advances the valve timing of the intake valve 50 by using a centrifugal force generated by the rotation of the cam shaft 6 (the cam sprocket 53).

As illustrated in FIGS. 3 and 4, the variable valve mechanism 100 includes the cam shaft 6, the cam sprocket 53, and the pair of link members 7 (the first link member 71 and the second link member 72). The cam sprocket 53 is provided at a right end of the cam shaft 6 and the pair of link members 7 are attached to a right surface of the cam sprocket 53. Hereinafter, components of the variable valve mechanism 100 will be described.

Figure 6:
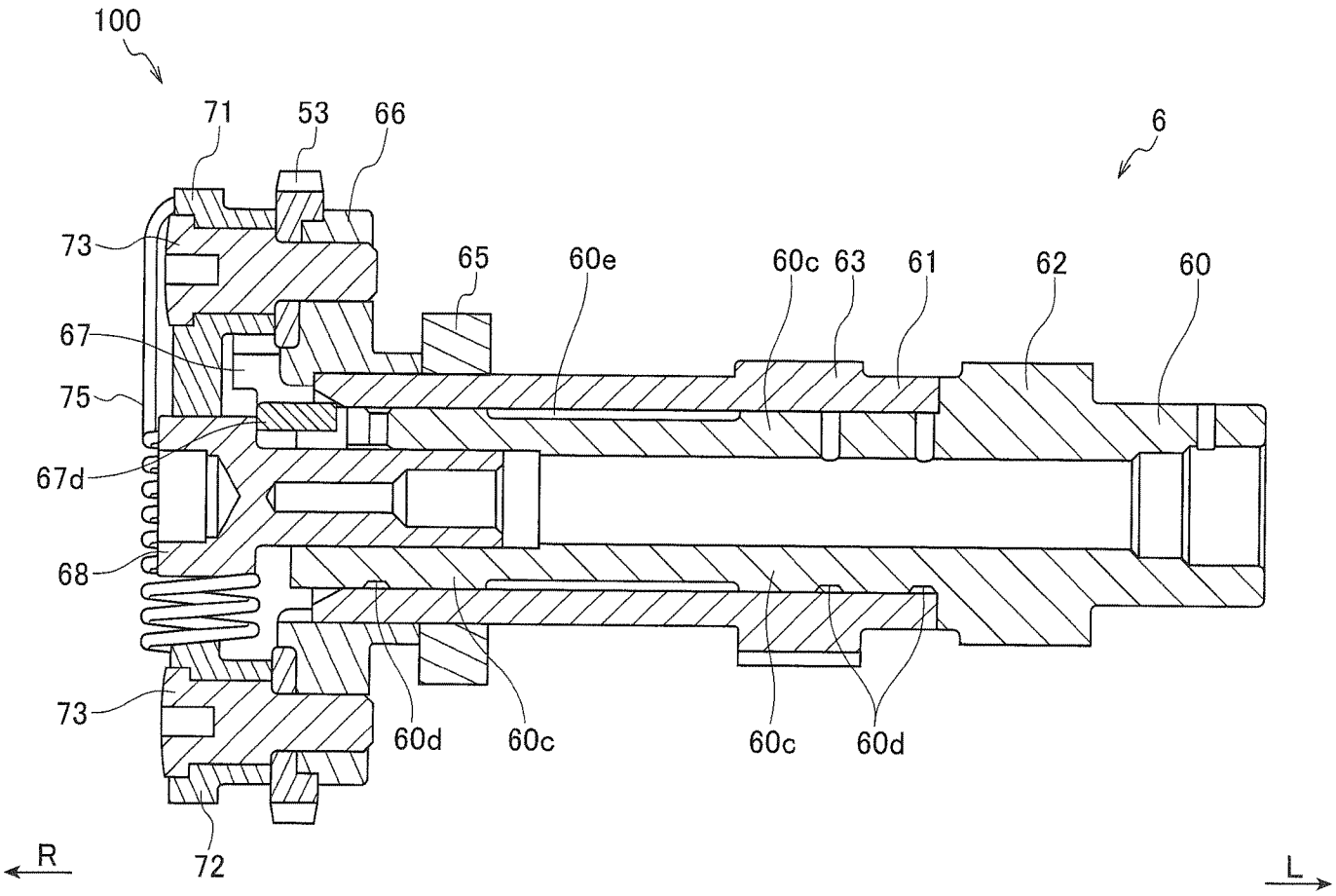

First, a configuration of the cam shaft 6 including the variable valve mechanism 100 according to the embodiment will be described. FIG. 5 is an exploded perspective view of the cam shaft 6 according to the embodiment. FIG. 6 is a cross-sectional view of the variable valve mechanism 100 illustrated in FIG. 3. In FIG. 5, a link flange 67 constituting a part of the cam shaft 6 is omitted for convenience of the description.

As illustrated in FIGS. 5 and 6, the cam shaft 6 has a configuration in which a sprocket flange 66 is attached to a right end of the exhaust cam shaft 61 through a bearing 65, the cylindrical exhaust cam shaft 61 is attached to the intake cam shaft 60, and an link flange 67 is attached to a right end of the intake cam shaft 60 (the link flange 67 is not illustrated in FIG. 5, but is illustrated in FIG. 4).

The intake cam shaft 60 is formed in a hollow shape and extends in the left and right direction. The intake cam 62 is integrally formed at the left end of the intake cam shaft 60. A screw hole 60*a* for a bolt 68 (see FIGS. 4 and 6) to be described later is provided at the right end of the intake cam shaft 60. Further, an engagement groove 60*b* which engages with an engagement pin 67*d* of the link flange 67 is formed at the outer peripheral side of the right end of the intake cam shaft 60.

Further, a portion which is located on the right side of the intake cam 62 in the intake cam shaft 60 and is received inside the exhaust cam shaft 61 is formed so that a base end and a right end are larger (thicker) than an intermediate portion 60*e* in the radial direction. The thick portion of the intake cam shaft 60 serves as a support portion 60*c* which supports the exhaust cam shaft 61. Specifically, an outer diameter of the support portion 60*c* is substantially equal to an inner diameter of the exhaust cam shaft 61. Further, an outer surface of the support portion 60*c* is provided with an annular groove 60*d*. The annular groove 60*d* and the intermediate portion 60*e* serve as an oil supply path which supplies oil to a sliding surface between the intake cam shaft 60 and the exhaust cam shaft 61.

The exhaust cam shaft 61 is formed such that the exhaust cam 63 is integrally formed at a left end, that is, an end opposite to the sprocket flange 66 and has a cylindrical shape through which the intake cam shaft 60 is insertable. Specifically, an inner diameter of the exhaust cam shaft 61 is set to be slightly larger than an outer diameter of the intake cam shaft 60. A length of the exhaust cam shaft 61 is substantially the same as a length of the intake cam shaft 60 on the right side of the intake cam 62. Further, the exhaust cam shaft 61 and the intake cam shaft 60 are formed to be rotatable relatively to each other.

The sprocket flange 66 which is provided at the right end of the exhaust cam shaft 61 is provided with two screw holes 66*a* corresponding to the penetration hole 53b of the cam sprocket 53. The sprocket flange 66 is attached to the exhaust cam shaft 61 to be rotatable together. Further, the cam sprocket 53 is fixed to the sprocket flange 66 by a bolt 73 to be described later.

The link flange 67 includes, as illustrated in FIG. 4, a circular portion 67*a* which engages with the intake cam shaft 60 and a flange portion 67*b* which is widened outward in the radial direction from the outer periphery of the circular portion 67*a*. A circular hole 67*c* is formed at the center of the circular portion 67*a*. When the bolt 68 is inserted through the circular hole 67*c* and the bolt 68 is threaded into the intake cam shaft 60, the link flange 67 is fixed to the intake cam shaft 60. Additionally, the link flange 67 is fixed to the intake cam shaft 60 with the cam sprocket 53 interposed therebetween.

The engagement pin 67*d* is attached to the circular portion 67*a* at a position separated from the center in the radial direction. The engagement pin 67*d* protrudes toward the intake cam shaft 60. When the engagement pin 67*d* engages with the engagement groove 60*b* of the intake cam shaft 60, the link flange 67 and the intake cam shaft 60 rotate together. The flange portion 67*b* is provided with two engagement pins 67*e* which protrude outward in the axial direction (rightward). The engagement pins 67*e* engage with engagement grooves 71*d* and 72*d* of the first link member 71 and the second link member 72 to be described later.

As illustrated in FIG. 4, the cam sprocket 53 is disposed between the sprocket flange 66 and the link flange 67 of the cam shaft 6. A circular hole 53*a* is formed at the center of the cam sprocket 53. Further, a side surface of the cam sprocket 53 is provided with two penetration holes 53*b* which serve as swing support points of the pair of link members 7. Two penetration holes 53*b* are disposed at positions facing each other with the circular hole 53*a* interposed therebetween.

Figure 7:
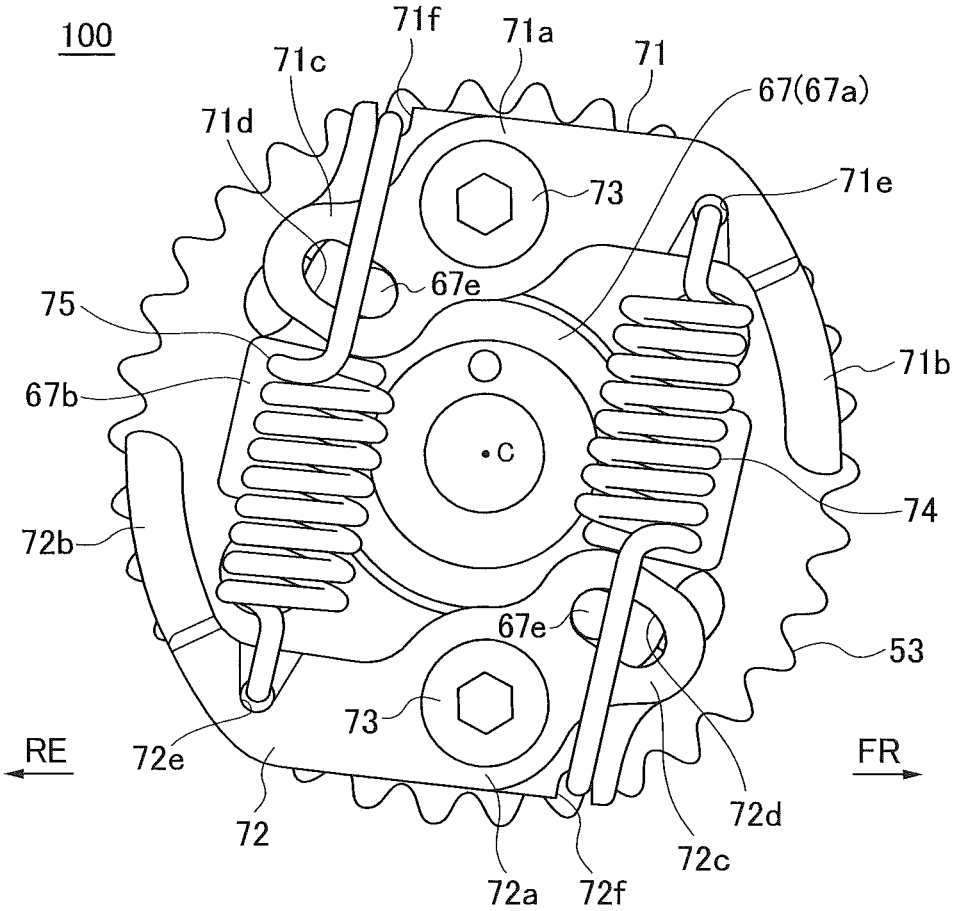
FIG. 7 is a side view of the variable valve mechanism illustrated in FIG. 3.

Next, a configuration of the pair of link members 7 of the variable valve mechanism 100 according to the embodiment will be described with reference to FIG. 7. FIG. 7 is a side view of the variable valve mechanism 100 illustrated in FIG. 3. FIG. 7 illustrates the variable valve mechanism 100 illustrated in FIG. 3 from the right side. Further, for convenience of the description, the bolt 68 which fixes the link flange 67 to the intake cam shaft 60 is not illustrated in FIG. 7. FIG. 7 illustrates a state (a non-swing state) where the pair of link members 7 do not swing. The same applies to FIGS. 8 and 10 below.

As illustrated in FIG. 7, the pair of link members 7 include the first link member 71 and the second link member 72 which have the same configuration. The first link member 71 is disposed at the side opposite to the second link member 72 with the rotation axis of the cam sprocket 53 (the cam shaft 6) interposed therebetween. More specifically, the first link member 71 and the second link member 72 are disposed to be point-symmetrical to each other with respect to the center C of the rotation axis of the cam sprocket 53 and the cam shaft 6.

The first link member 71 is formed in a substantially crescent shape along the circumferential direction of the cam sprocket 53. The first link member 71 includes a support portion 71*a* which is supported by the cam sprocket 53 to be swingable (rotatable), a weight portion 71*b* which is formed to be separated from the support portion 71*a*, and an engagement portion 71*c* which engages with a part (the engagement pin 67*e*) of the link flange 67 (see FIG. 4). A locking hole 71*e* which locks one end of a first spring 74 to be described later is formed between the support portion 71*a* and the weight portion 71*b*. The locking hole 71*e* is disposed in the vicinity of a base end of the weight portion 71*b*. Further, a locking portion 71*f* which locks the other end of a second spring 75 to be described later is formed above the engagement portion 71*c*.

The support portion 71*a* is formed in a cylindrical shape through which the bolt 73 is insertable. The bolt 73 which is inserted through the support portion 71*a* and is fixed to the sprocket flange 66 through the cam sprocket 53 serves as a swing shaft of the first link member 71. The first link member 71 extends from the support portion 71a toward the front side in the rotation direction and a front end thereof is slightly bent inward in the radial direction. The bent front end portion is formed as the weight portion 71*b*. Further, the engagement portion 71*c* extends from the support portion 71*a* toward the rear side in the rotation direction and a rear end thereof is slightly located at the inside in the radial direction in relation to the support portion 71*a*. The rear end portion of the engagement portion 71*c* is provided with the engagement groove 71*d* which engages with the engagement pin 67*e*.

Similarly to the first link member 71, the second link member 72 is formed in a substantially crescent shape along the circumferential direction of the cam sprocket 53. The second link member 72 includes a support portion 72*a* which is supported by the cam sprocket 53 to be rotatable, a weight portion 72*b* which is formed to be separated from the support portion 72*a*, and an engagement portion 72*c* which engages with the link flange 67 (the engagement pin 67*e*). A locking hole 72*e* which locks one end of the second spring 75 to be described later is formed between the support portion 72*a* and the weight portion 72*b*. The locking hole 72*e* is provided in the vicinity of a base end of the weight portion 72*b*. Further, a locking portion 72*f* which locks the other end of the first spring 74 to be described later is formed below the engagement portion 72*c*.

The support portion 72*a* has a cylindrical shape through which the bolt 73 is insertable. The bolt 73 which is inserted through the support portion 72*a* and is fixed to the sprocket flange 66 through the cam sprocket 53 serves as a swing shaft of the second link member 72. The second link member 72 extends backward in the rotation direction from the support portion 72*a* and a front end is slightly bent inward in the radial direction. The bent front end portion is formed as the weight portion 72*b*. Further, the engagement portion 72*c* slightly extends toward the front side in the rotation direction from the support portion 72*a* and a front end is slightly located at the inside of the radial direction in relation to the support portion 72*a*. The rear end portion of the engagement portion 72*c* is provided with the engagement groove 72*d* which engages with the engagement pin 67*e*.

The first link member 71 is attached to the cam sprocket 53 to be swingable when the bolt 73 is inserted through the penetration hole 53*b* of the cam sprocket 53 and the support portion 71*a* while the engagement pin 67*e* of the link flange 67 engages with the engagement groove 71*d* and the bolt 73 is threaded into the sprocket flange 66. Similarly, the second link member 72 is attached to the cam sprocket 53 to be swingable when the bolt 73 is inserted through the penetration hole 53*b* of the cam sprocket 53 and the support portion 72*a* while the engagement pin 67*e* of the link flange 67 engages with the engagement groove 72*d* and the bolt 73 is threaded into the sprocket flange 66.

Figure 8:
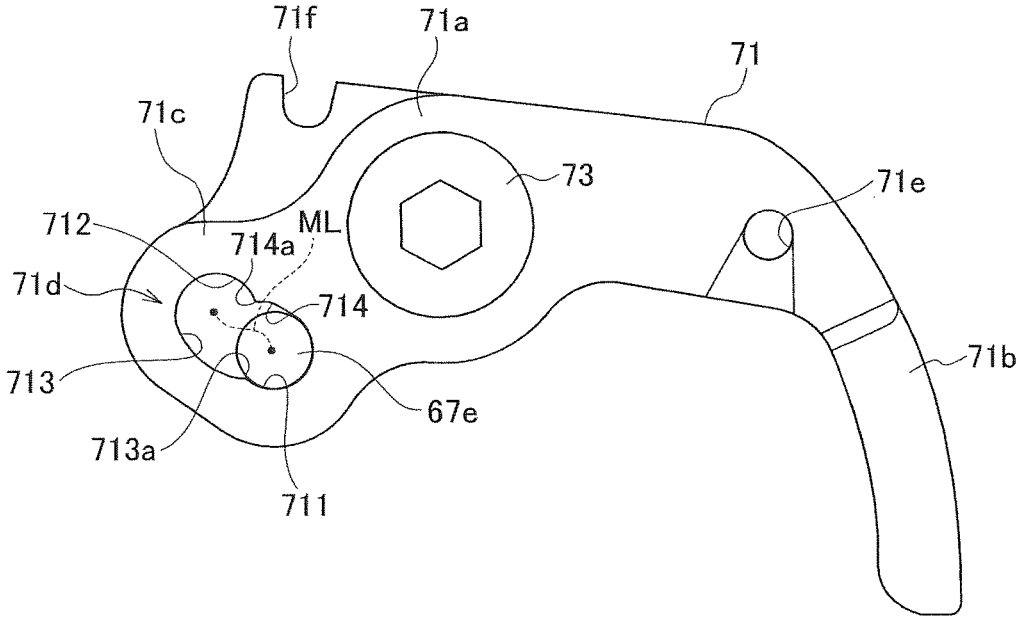
FIG. 8 is an enlarged view of a link member that belongs to the variable valve mechanism according to the embodiment.

Here, configurations of the engagement grooves 71*d* and 72*d* formed in the first link member 71 and the second link member 72 will be described with reference to FIG. 8. FIG. 8 is an enlarged view of the link member 7 (the first link member 71) of the variable valve mechanism 100 according to the embodiment. The engagement grooves 71*d* and 72*d* which are formed in the first link member 71 and the second link member 72 have the same configuration except for the direction. Here, a description will be made by using the engagement groove 71*d* of the first link member 71 and a description of the engagement groove 72*d* formed in the second link member 72 will be omitted.

As illustrated in FIG. 8, the engagement groove 71*d* has an elongated hole shape which extends in the radial direction of the cam sprocket 53 while the first link member 71 does not swing. The engagement groove 71*d* includes a first holding position 711 which holds the engagement pin 67*e* in a state where the first link member 71 does not swing to a predetermined position or more (in other words, a state where the first link member 71 is closed) and a second holding position 712 which holds the engagement pin 67*e* in a state where the first link member 71 swings to a predetermined position or more (in other words, a state where the first link member 71 is opened). The first holding position 711 and the second holding position 712 are substantially circular. The engagement groove 71*d* includes the first holding position 711 and the second holding position 712 formed at both ends thereof and these holding positions are connected to each other.

A first stopper portion 713*a* which protrudes toward the facing inner wall surface 714 of the engagement groove 71*d* in the vicinity of the first holding position 711 is provided at the inner wall surface 713 disposed at a farther side from the bolt 73 in the inner wall surface of the engagement groove 71*d*. The first stopper portion 713*a* is used so that the engagement pin 67*e* received in the first holding position 711 does not easily move toward the second holding position 712. Meanwhile, a second stopper portion 714*a* which protrudes toward the facing inner wall surface 713 of the engagement groove 71*d* in the vicinity of the second holding position 712 is provided at the inner wall surface 714 disposed at a close side to the bolt 73 in the inner wall surface of the engagement groove 71*d*. The second stopper portion 714*a* is used so that the engagement pin 67*e* received in the second holding position 712 does not easily move toward the first holding position 711.

The engagement groove 71*d* is provided with a substantially S-shaped moving line ML in which the center of the engagement pin 67*e* bypasses the first stopper portion 713*a* and bypasses the second stopper portion 714*a*. That is, when the engagement pin 67*e* inside the engagement groove 71*d* moves from the first holding position 711 to the second holding position 712, the engagement pin reaches the second holding position 712 along a path in which the center moves away from the first stopper portion 713*a* and moves away from the second stopper portion 714*a*.

Further, the first link member 71 and the second link member 72 are provided with a pair of springs (the first spring 74 and the second spring 75) which respectively urge the weight portions 71*b* and 72*b* inward in the radial direction of the cam sprocket 53. For example, these springs are formed as compression coil springs. The first spring 74 is disposed at the side opposite to the second spring 75 with the rotation axis of the cam sprocket 53 (the cam shaft 6) interposed therebetween. More specifically, the first spring 74 and the second spring 75 are disposed to be point-symmetrical to each other with respect to the center C of the rotation axis of the cam sprocket 53 and the cam shaft 6.

One end (an upper end) of the first spring 74 is locked to the locking hole 71*e* at the side of the weight portion 71*b* of the first link member 71. Meanwhile, the other end (a lower end) of the first spring 74 is locked to the locking portion 72*f* at the side of the engagement portion 72*c* of the second link member 72. Further, one end (a lower end) of the second spring 75 is locked to the locking hole 72*e* at the side of the weight portion 72*b* of the second link member 72. Meanwhile, the other end (an upper end) of the second spring 75 is locked to the locking portion 71*f* at the side of the engagement portion 71*c* of the first link member 71. Both ends of the first spring 74 and the second spring 75 are locked by the first link member 71 and the second link member 72 so that an urging force of pulling both link members inward in the radial direction of the cam sprocket 53 is exerted.

Figure 9A:
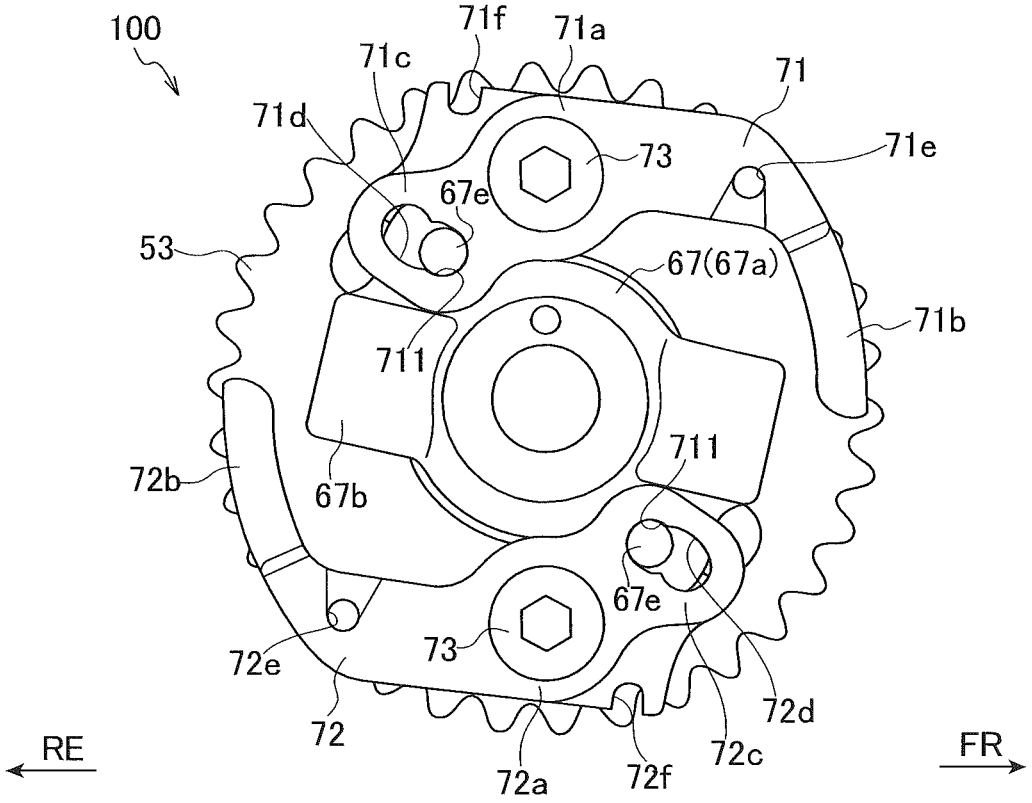
FIGS. 9A and 9B are diagrams illustrating a positional relation of components of a link member of the variable valve mechanism according to the embodiment.
Figure 9B:
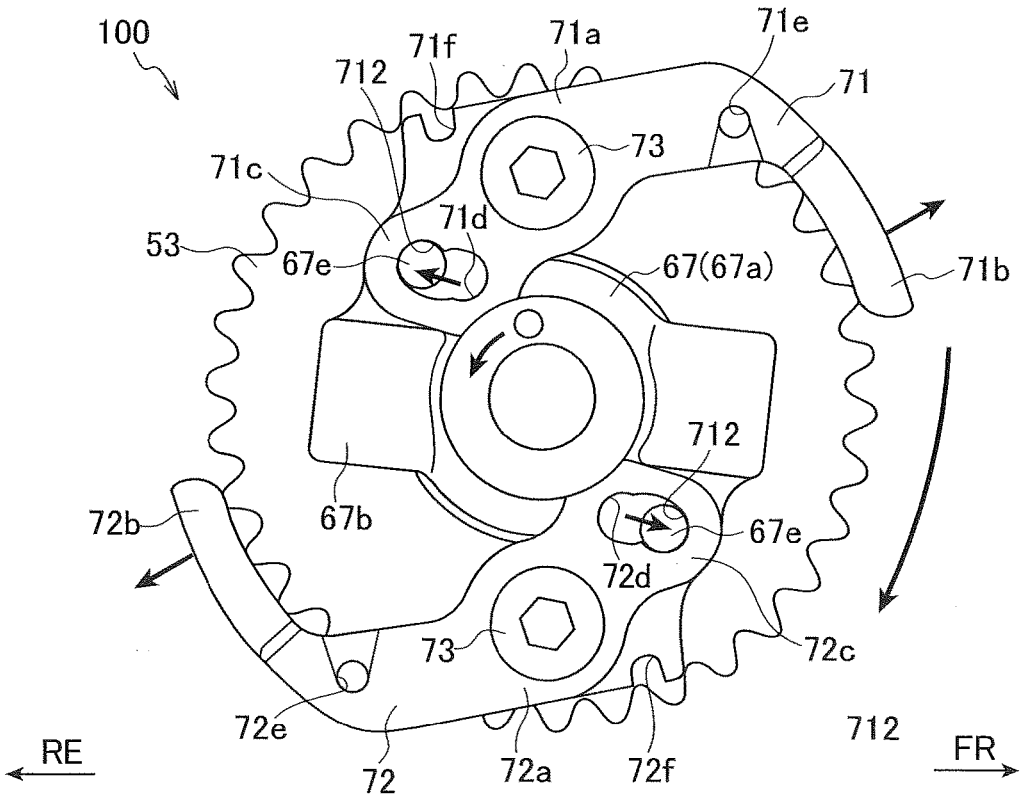

Next, an operation of the variable valve mechanism 100 with such a configuration will be described with reference to FIGS. 9A and 9B. FIGS. 9A and 9B are diagrams illustrating an operation of the variable valve mechanism 100 according to the embodiment. FIG. 9A illustrates a state (a non-swing state: a closed state) where the pair of link members 7 do not swing and FIG. 9B illustrates a state (a swing state: an opened state) where the pair of link members 7 swing to maximum. Further, for convenience of the description, the bolt 68, the first spring 74, and the second spring 75 are not illustrated in FIGS. 9A and 9B.

In the variable valve mechanism 100, as illustrated in FIGS. 9A and 9B, the first link member 71 and the second link member 72 are urged inward in the radial direction of the cam sprocket 53 by the first spring 74 and the second spring 75. For example, when an engine rotation speed is a predetermined rotation speed or less, centrifugal forces generated by the weight portions 71*b* and 72*b* are smaller than the urging forces of the first spring 74 and the second spring 75 as illustrated in FIG. 9A. For this reason, the first link member 71 and the second link member 72 do not swing about the support portions 71*a* and 72*a* as swing support points.

Further, the weight portions 71*b* and 72*b* are located at positions not protruding outward in the radial direction from the outer edge of the cam sprocket 53. At this time, the engagement pin 67*e* of the link flange 67 is received in the first holding position 711 at the inside of the engagement grooves 71*d* and 72*d* in the radial direction. In this case, the link flange 67 and the cam sprocket 53 rotate together without relative rotation. Accordingly, the intake cam shaft 60 and the exhaust cam shaft 61 (which are illustrated in FIG. 5) which engage with the link flange 67 also rotate together with the cam sprocket 53. As a result, in the valve train 5 (see FIG. 2), the opening and closing of the intake valve 50 and the exhaust valve 51 is controlled at a normal valve timing.

Meanwhile, when an engine rotation speed exceeds a predetermined rotation speed, the centrifugal forces generated by the weight portions 71*b* and 72*b* become larger than the urging forces of the first spring 74 and the second spring 75. For this reason, as illustrated in FIG. 9B, the first link member 71 and the second link member 72 swing about the bolt 73 inserted through the support portions 71*a* and 72*a* and the weight portions 71*b* and 72*b* move outward in the radial direction of the cam sprocket 53. Accordingly, the weight portions 71*b* and 72*b* are located at positions protruding outward in the radial direction from the outer edge of the cam sprocket 53.

Further, when the first link member 71 and the second link member 72 swing, the engagement portions 71*c* and 72C move inward in the radial direction. Accordingly, the link flange 67 rotates in the opposite direction relatively to the cam sprocket 53 while the engagement pin 67*e* is received in the second holding position 712 at the outside of the radial direction of the engagement grooves 71*d* and 72*d*. Accordingly, the intake side cam shaft 60 which engages with the link flange 67 rotates relatively to the cam sprocket 53. As a result, the opening/closing timing of the intake valve 50 is adjusted. In this way, in the variable valve mechanism 100, when the first link member 71 and the second link member 72 are swung in response to the engine rotation speed so that the intake side cam shaft 60 (the link flange 67) and the cam sprocket 53 rotate relatively to each other, the opening/closing timing of the intake valve 50 can be changed.

In this way, in the variable valve mechanism 100 according to the embodiment, the first link member 71 and the second link member 72 swing to the outside of the cam sprocket 53 in the radial direction under a predetermined condition so that the intake side cam shaft 60 (the link flange 67) rotates relatively to the cam sprocket 53. For this reason, the phase in the rotation direction of the intake side cam shaft 60 can be changed in response to the swing operation of the link member 7 (the first link member 71 and the second link member 72). Accordingly, an operating resistance can be suppressed to be low compared to a known configuration in which the centrifugal weight is sandwiched between the pair of driven members. As a result, the phase of the cam shaft 6 in the rotation direction can be smoothly changed.

Further, the first link member 71 includes the bolt 73 which is fixed to the cam sprocket 53 and serves as a swing shaft, the weight portion 71*b* which is disposed to be separated from the bolt 73, and the engagement portion 71*c* which engages with the engagement pin 67*e* provided at the cam shaft 6 and transmits the rotation of the cam sprocket 53 to the cam shaft 6 and is supported by the cam sprocket 53 to be swingable. Here, in accordance with the rotation of the cam sprocket 53, the weight portion 71*b* moves outward in the radial direction of the cam sprocket 53 and the engagement portion 71*c* moves to move the engagement pin 67*e*, thereby relatively rotating the intake side cam shaft 60. The same applies to the second link member 72. Accordingly, the intake side cam shaft 60 can be rotated relatively when the first link member 71 and the second link member 72 swung by the centrifugal force generated in accordance with the rotation of the cam sprocket 53 (in response to a change in rotation speed). For this reason, it is possible to smoothly change the phase in the rotation direction of the cam shaft 6 with a simple configuration without requiring a particular control mechanism for relatively rotating the intake side cam shaft 60.

Further, since the first link member 71 and the second link member 72 are swung by the centrifugal force generated by the rotation of the cam sprocket 53, a friction force of the bolt 73 can be reduced. For this reason, the weight portions 71*b* and 72*b* can be moved even when a change in torque of the engine 2 does not occur. As a result, it is possible to easily perform an inspection or an operation check of the cam shaft 6.

Further, in the variable valve mechanism 100 according to the embodiment, the first link member 71 and the second link member 72 are disposed at the opposite side with the rotation axis of the cam sprocket 53 interposed therebetween and the first spring 74 and the second spring 75 are disposed at the opposite side with the rotation axis of the cam sprocket 53 interposed therebetween. Accordingly, the first link member 71 and the second link member 72 can be disposed with a good balance along with the first spring 74 and the second spring 75. For this reason, the rotation of the cam shaft 6 can be smoothly kept without a weight portion for ensuring a balance.

In particular, the first link member 71 and the second link member 72 are disposed to be point-symmetrical to each other with respect to the center C of the rotation axis of the cam sprocket 53. For this reason, a rotation force generated from the cam sprocket 53 can be symmetrically transmitted to the cam shaft 6 through the link members 7. Accordingly, the rotation of the cam shaft 6 can be smoothly performed. Further, the rotation of the cam shaft 6 can be smoothly kept without a weight portion for ensuring a balance.

Further, the engagement grooves 71*d* and 72*d* are provided at the engagement portions 71*c* and 72*c* of the first link member 71 and the second link member 72. The first holding position 711 and the second holding position 712 are respectively provided in the engagement grooves 71*d* and 72*d* and the first stopper portion 713*a* which protrudes toward the facing inner wall surface 714 is provided in the inner wall surface 713 disposed at a farther side from the bolt 73 in the inner wall surfaces of the engagement grooves 71*d* and 72d. For this reason, the engagement pin 67*e* received in the first holding position 711 cannot move easily. Accordingly, even when a driving reaction force which is given from the intake valve 50 (the exhaust valve 51) to the intake cam 62 (the exhaust cam 63) is transmitted to the first link member 71 and the second link member 72 through the cam shaft 6 and the engagement portions 71*c* and 72*c*, the vibration of the first link member 71 and the second link member 72 can be suppressed.

Similarly, the second stopper portion 714*a* which protrudes toward the facing inner wall surface 713 is provided in the inner wall surface 714 disposed at a close side from the bolt 73 in the inner wall surfaces of the engagement grooves 71*d* and 72*d*. For this reason, the engagement pin 67*e* received in the second holding position 712 cannot move easily. Accordingly, even when a driving reaction force given from the intake valve 50 (the exhaust valve 51) to the intake cam 62 (the exhaust cam 63) is transmitted to the first link member 71 and the second link member 72 through the cam shaft 6 and the engagement portions 71*c* and 72*c*, the vibration of the first link member 71 and the second link member 72 can be suppressed.

Further, the engagement grooves 71*d* and 72*d* are provided with a substantially S-shaped moving line in which the center of the engagement pin 67*e* bypasses the first stopper portion 713*a* and bypasses the second stopper portion 714*a*. For this reason, it is possible to prevent the engagement pin 67*e* received in the first holding position 711 or the second holding position 712 from moving easily compared to a case where the moving line of the engagement pin 67*e* is linear. Accordingly, the first link member 71 and the second link member 72 can be swung and the first link member 71 and the second link member 72 can be returned to the non-swing state at a desired timing.

Figure 10:
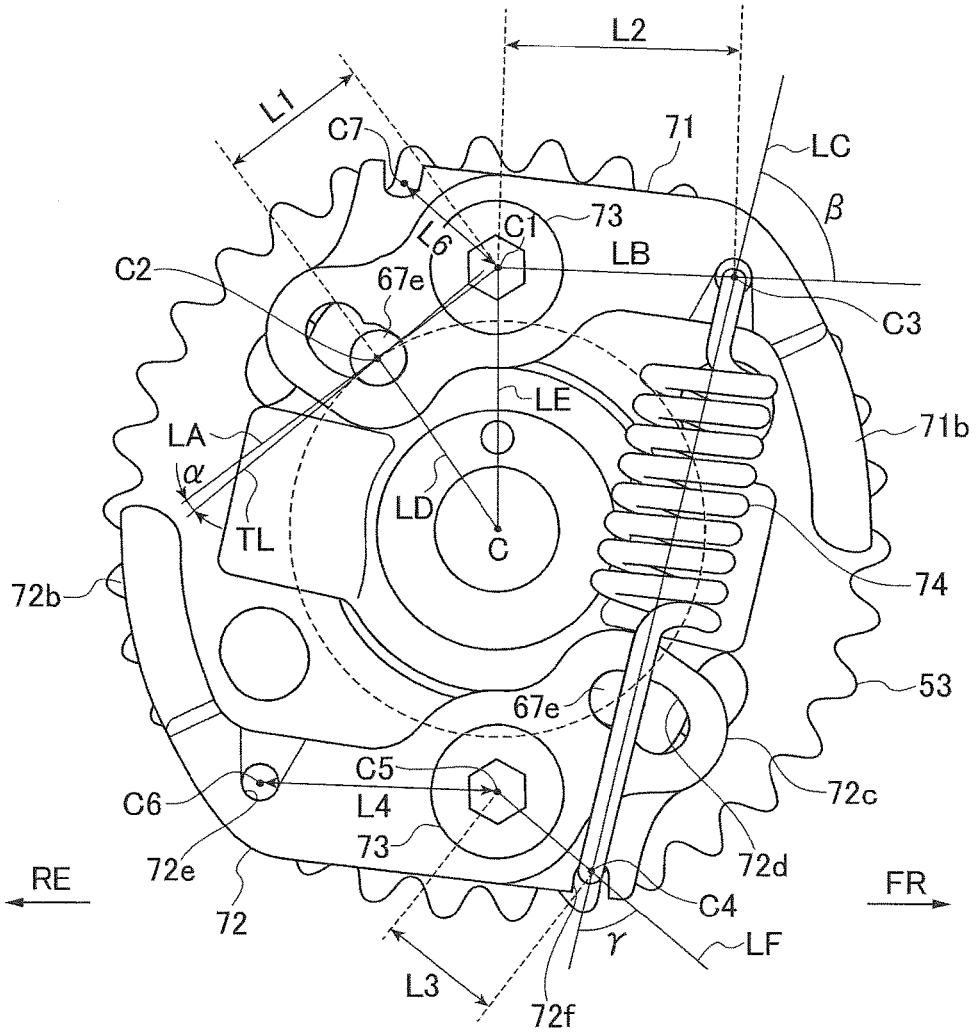
FIG. 10 is a diagram illustrating an operation of the variable valve mechanism according to the embodiment.

Here, a positional relation of the components of the link member 7 of the variable valve mechanism 100 according to the embodiment will be described with reference to FIG. 10. FIG. 10 is a diagram illustrating a positional relation of components of the link member 7 of the variable valve mechanism 100 according to the embodiment. The components of the first link member 71 and the components of the second link member 72 have the same positional relation. In the following description, a description will be made by using the first link member 71 and a detailed description of the second link member 72 will be omitted. Additionally, for convenience of the description, the second spring 75 is not illustrated in FIG. 10.

As illustrated in FIG. 10, the first link member 71 is formed so that a distance L1 of an imaginary line LA connecting a center C1 of the bolt 73 forming a swing shaft to a center C2 of the engagement pin 67*e* received in the first holding position 711 in the non-swing state is smaller than a distance L2 of an imaginary line LB connecting the center C1 of the bolt 73 and a locking position C3 of the first spring 74 with respect to the locking hole 71*e*.

In this way, since the distance L1 between the bolt 73 and the engagement pin 67*e* is set to be smaller than the distance L2 between the bolt 73 and the first spring 74, a rotation moment Ma for swinging the first link member 71 can be suppressed to be small when a driving reaction force given from the intake valve 50 (the exhaust valve 51) to the intake cam 62 (the exhaust cam 63) is transmitted to the first link member 71 through the cam shaft 6, the engagement pin 67e, and the engagement portion 71c. Accordingly, it is possible to prevent a problem in which the first link member 71 easily swings.

Here, a direction of the driving reaction force transmitted from the engagement pin 67*e* to the first link member 71 becomes a direction of a tangential line TL between a concentric circle and the cam shaft 6 passing through the center C2 of the engagement pin 67*e*. Here, the rotation moment Ma is obtained by the following equation when a force given from the engagement pin 67*e* by the driving reaction force is denoted by "F" and an angle formed by the imaginary line LA connecting the center C1 of the bolt 73 and the center C2 of the engagement pin 67*e* in the non-swing state and the tangential line TL of the circle indicated by the dashed line, passing through the center C2 of the engagement pin 67*e*, and using the rotation axis of the cam shaft 6 (the cam sprocket 53) as the center C is denoted by "α".

Rotation moment $Ma=F \sin \alpha \cdot L1$

Further, the first link member 71 is formed so that the angle α is smaller than an angle β formed by the imaginary line LB connecting the center C1 of the bolt 73 and the locking position C3 of the first spring 74 and the center line LC of the first spring 74.

In this way, since the angle α is set to be smaller than the angle β, the rotation moment Ma for swinging the first link member 71 can be suppressed to be smaller than the rotation moment Mb for pressing the first link member 71 by the first spring 74 and the second spring 75 when the driving reaction force given from the intake valve 50 (the exhaust valve 51) to the intake cam 62 (the exhaust cam 63) is transmitted to the first link member 71 through the cam shaft 6 and the engagement portion 71*c*. Accordingly, it is possible to prevent a problem in which the first link member 71 easily swings. Here, the rotation moment Mb is obtained by the following equation when the spring constants of the first spring 74 and the second spring 75 are denoted by "K" and the expansion lengths of the first spring 74 and the second spring 75 are denoted by "x".

Rotation moment $Mb=K \cdot x \sin \beta \cdot L2$

Further, the first link member 71 is disposed so that the imaginary line LA connecting the center C1 of the bolt 73 and the center C2 of the engagement pin 67*e* in the non-swing state intersects at a right angle to the imaginary line LD connecting the center C of the rotation axis of the cam shaft 6 (the cam sprocket 53) and the center 02 of the engagement pin 67*e*.

Accordingly, the bolt 73 is disposed in the vicinity of the movement direction accompanied by the rotation of the cam shaft 6, that is, the tangential direction in the non-swing state. For this reason, even when the driving reaction force given from the intake valve 50 (the exhaust valve 51) to the intake cam 62 (the exhaust cam 63) is transmitted to the first link member 71 through the cam shaft 6, the engagement pin 67*e*, and the engagement portion 71*c*, the direction of the driving reaction force substantially overlaps the imaginary line LA. Accordingly, since the angle α becomes very small, the rotation moment Ma for swinging the first link member 71 can be suppressed to minimum and thus an unexpected swing of the first link member 71 can be effectively suppressed.

Further, the first link member 71 is disposed so that the angle β including the rotation axis of the cam sprocket 53 among the angles formed by the imaginary line LB connecting the center C1 of the bolt 73 and the locking position C3 of the first spring 74 and the center line LC of the first spring 74 in the non-swing state becomes an acute angle.

In this way, since the angle β which is narrowed in accordance with an increase in swing angle of the first link member 71 is set to an acute angle in advance, the rotation radius of the weight portion 71*b* can be increased in accordance with an increase in swing angle of the first link member 71 and thus the centrifugal force of the weight portion 71*b* can be increased in proportional to the rotation radius. Accordingly, since the urging force increases as the swing angle of the first link member 71 increases in accordance with an increase in rotation speed of the cam sprocket 53, the first link member 71 can be immediately operated. Meanwhile, the first link member 71 can be returned to the non-swing state in accordance with a decrease in rotation speed of the cam sprocket 53. As a result, it is possible to improve the responsiveness of the operation of the first link member 71 in response to the rotation speed of the cam sprocket 53.

Further, the distance L2 between the center C1 of the bolt 73 of the first link member 71 and the locking position C3 of the first spring 74 with respect to the locking hole 71*e* of the first link member 71 is set to be larger than a distance L3 of an imaginary line LF connecting a center C5 of the bolt 73 of the second link member 72 and a locking position C4 of the first spring 74 with respect to the locking portion 72*f* of the second link member 72. Further, a distance L4 between the center C5 of the bolt 73 of the second link member 72 and a locking position C6 of the second spring 75 with respect to the locking hole 72*e* of the second link member 72 is set to be larger than a distance L6 between the center C1 of the bolt 73 of the first link member 71 and the locking position C7 of the second spring 75 with respect to the locking portion 71*f* of the first link member 71.

Accordingly, even in a structure of pulling the weight portions 71*b* and 72*b* and the engagement portions 71*c* and 72*c* of the first link member 71 and the second link member 72, the rotation moment Mc of the weight portions 71*b* and 72*b* becomes larger than the rotation moment Md of the engagement portions 71*c* and 72*c* and thus the first link member 71 and the second link member 72 thereof can be urged in the non-swing direction. Accordingly, even when the locking positions of the first spring 74 and the second spring 75 are provided at the weight portions 71*b* and 72*b* and the engagement portions 71*c* and 72*c* in a narrow space, the phase in the rotation direction of the cam shaft 6 can be stably changed.

Here, the rotation moment Mc is expressed by the following equation when the spring constants of the first spring 74 and the second spring 75 are denoted by "K" and the expansion lengths of the first spring 74 and the second spring 75 are denoted by "x". Further, the rotation moment Md is obtained by the following equation when the spring constants of the first spring 74 and the second spring 75 are denoted by "K", the expansion lengths of the first spring 74 and the second spring 75 are denoted by "x", and the angle between the center line LC and the imaginary line LF is denoted by "r".

Rotation moment $Mc=K \cdot x \sin \beta \cdot L2$

Rotation moment $Md=K \cdot x \sin \gamma \cdot L3$

Regarding the first link member 71 and the second link member 72, the weight portions 71*b* and 72*b* are disposed at one side and the engagement portions 71*c* and 72*c* are disposed at the other side in an imaginary line LE connecting the center C1 of the bolt 73 and the center C of the rotation axis of the cam sprocket 53. Then, one end of the first spring 74 is locked to the locking hole 71*e* at the side of the weight portion 71*b* of the first link member 71 and the other end thereof is locked to the locking portion 72*f* at the side of the engagement portion 72*c* of the second link member 72. Meanwhile, one end of the second spring 75 is locked to the locking hole 72*e* at the side of the weight portion 72*b* of the second link member 72 and the other end thereof is locked to the locking portion 71*f* at the side of the engagement portion 71*c* of the first link member 71.

That is, both the first spring 74 and the second spring 75 are respectively locked to the first link member 71 and the second link member 72. For this reason, when one ends (ends on the side of the weight portions 71*b* and 72*b*) of the first spring 74 and the second spring 75 are pulled outward in the radial direction of the cam sprocket 53, the other ends (ends on the side of the engagement portions 72*c* and 71*c*) of the second spring 75 and the first spring 74 move inward in the radial direction of the cam sprocket 53. Accordingly, since the expansion/contraction amounts of the first spring 74 and the second spring 75 can be decreased, a burden on the springs can be reduced.

Further, since both ends of the first spring 74 and the second spring 75 are locked to the first link member 71 and the second link member 72, the first spring 74 and the second spring 75 are operated at the same time when the first link member 71 and the second link member 72 swing. For this reason, the first spring 74 and the second spring 75 do not interfere with each other. Accordingly, since the first link member 71 and the second link member 72 can be disposed at a close position, the variable valve mechanism 100 can have a simple and compact structure.

Additionally, the invention is not limited to the above-described embodiment and can be modified into various forms. In the above-described embodiment, the sizes or the shapes illustrated in the accompanying drawings are not limited thereto and can be appropriately changed without departing from the effect of the invention. In addition, an appropriately modification can be made without departing from the object of the invention.

For example, in the above-described embodiment, a case has been described in which the pair of link members 7 (the first link member 71 and the second link member 72) are provided and the pair of first springs 74 and the second spring 75 are provided, but the invention is not limited to this configuration. For example, the number of link members or springs may be one or three or more on the condition that the phase of the rotation direction of the intake cam shaft 60 can be changed in accordance with the rotation of the cam sprocket 53.

Further, in the above-described embodiment, a case has been described in which the first link member 71 and the second link member 72 are disposed to be point-symmetrical to each other with respect to the center C of the rotation axis of the cam sprocket 53, but the invention is not limited to this configuration. The first link member 71 and the second link member 72 can be disposed at arbitrary positions on the condition that the phase of the rotation direction of the intake cam shaft 60 can be changed in accordance with the rotation of the cam sprocket 53.

Further, in the above-described embodiment, the single cylinder engine 2 has been exemplified, but the invention is not limited to this configuration. For example, the valve train 5 (the variable valve mechanism 100) according to the embodiment may be also applied to a multi-cylinder engine.

Further, in the above-described embodiment, the single cylinder engine has a so-called four valve type valve train in which each of the intake valve 50 and the exhaust valve 51 is provided at two positions so that four valves are provided in total, but the invention is not limited to this configuration. The number of the intake valves 50 and the exhaust valves 51 can be appropriately changed.

Further, in the above-described embodiment, a case in which the variable valve mechanism 100 is applied to the SOHC type valve train 5 has been described, but the invention is not limited to this configuration. For example, the variable valve mechanism 100 may be also applied to a double overhead camshaft (DOHC) type valve train.

Further, in the above-described embodiment, a configuration has been described in which one of engagement portions is formed as an engagement pin and the other thereof is formed as an engagement hole or a groove, but the invention is not limited to this configuration. For example, one of the engagement portions may be formed as an engagement hole or a groove and the other thereof may be formed as a protrusion such as an engagement pin.

Further, in the above-described embodiment, the variable valve mechanism 100 is used to adjust the opening/closing timing of the intake valve 50, but the invention is not limited to this configuration. The variable valve mechanism 100 may be used to adjust the opening/closing timing of the exhaust valve 51.

Further, in the above-described embodiment, a predetermined centrifugal force (an engine rotation speed) during the operation of the variable valve mechanism 100 (when the first link member 71 and the second link member 72 swing) can be appropriately changed in response to a desired valve timing.

INDUSTRIAL APPLICABILITY

As described above, the invention has an effect that a phase of a rotation direction of a cam shaft can be stably changed and is particularly useful for a variable valve mechanism applicable to a single overhead camshaft (SOHC) type valve train, an engine, and an automatic two-wheeled vehicle.

REFERENCE SIGNS LIST

1 automatic two-wheeled vehicle
2 engine
5 valve train
50 intake valve
51 exhaust valve
53 cam sprocket
6 cam shaft
60 intake cam shaft
61 exhaust cam shaft
62 intake cam (intake side cam)
63 exhaust cam (exhaust side cam)
66 sprocket flange
67 link flange
100 variable valve mechanism
7 link member
71 first link member
71*a*, 72*a* support portion
71*b*, 72*b* weight portion
71*c*, 72*c* engagement portion
71*d*, 72*d* engagement groove (groove)
711 first holding position
712 second holding position
713*a* first stopper portion
714*a* second stopper portion
72 second link member
73 bolt (swing shaft)
74 first spring (first urging member)
75 second spring (second urging member)

What is claimed is:

1. A variable valve mechanism which changes an opening/closing timing of an intake valve or an exhaust valve in response to an engine rotation speed, the variable valve mechanism comprising:

a cam sprocket which rotates in response to a rotation of a crank shaft;

a cam shaft which is integrated with any one of intake side and exhaust side cams and is provided to be rotatable relatively to the cam sprocket; and a link member that engages with the cam sprocket and the cam shaft and transmits a rotation from the cam sprocket to the cam shaft, wherein the link member is supported by the cam sprocket to be swingable and swings in response to a change in rotation speed of the cam sprocket to rotate the cam shaft relatively to the cam sprocket, the link member includes:

a swing shaft which is fixed to the cam sprocket;

a weight portion which is disposed to be separated from the swing shaft; and an engagement portion which engages with an engagement pin provided in the cam shaft and transmits a rotation of the cam sprocket to the cam shaft;

the link member is supported by the cam sprocket to be swingable; and the weight portion moves outward in a radial direction of the cam sprocket and the engagement portion moves to move the engagement pin in accordance with the rotation of the cam sprocket so that the cam shaft rotates relatively to the cam sprocket;

the engagement portion is formed as a groove having an inner wall surface, and the groove is provided with a first holding position which receives the engagement pin while the link member does not swing to a predetermined position or more and a second holding position which receives the engagement pin while the link member swings to a predetermined position or more, a first stopper portion is provided in the inner wall surface disposed at a farther side from the swing shaft in a vicinity of the first holding position, and the first stopper portion protrudes toward the inner wall surface facing the first stopper portion.

2. The variable valve mechanism according to claim 1, further comprising:

a spring that is locked to the link member and urges the weight portion inward in the radial direction of the cam sprocket, wherein in a non-swing state of the link member, a distance of an imaginary line connecting a center of the swing shaft and a center of the engagement pin is smaller than a distance of an imaginary line connecting the center of the swing shaft to a locking position of the spring on the link member.

3. The variable valve mechanism according to claim 2, wherein in the non-swing state of the link member, an angle$\alpha$ formed by the imaginary line connecting the center of the swing shaft and the center of the engagement pin and a tangential line of a circle using a rotation axis of the cam shaft as a center and passing through the center of the engagement pin is smaller than an angle $\beta$ formed by a center line of the spring and the imaginary line connecting the center of the swing shaft and the locking position of the spring.

4. The variable valve mechanism according to claim 2, wherein the spring is disposed so that one end of the spring is locked to a position near the weight portion in relation to the swing shaft, an angle $\beta$ formed by a center line of the spring and an imaginary line passing through the locking position of the spring and the center of the swing shaft is an acute angle, and the imaginary line and the center line forming the angle $\beta$ interpose a rotation axis of the cam sprocket.

5. The variable valve mechanism according to claim 2, wherein the link member is a first link member and the variable valve mechanism further includes an identical second link member, the first link member is disposed at one side of a rotation axis of the cam sprocket and the second link member is disposed at another side of the rotation axis of the cam sprocket so that the first link member and the second link member interpose the rotation axis of the cam sprocket, the spring is a first spring and the variable valve mechanism further includes an identical second spring the first spring is disposed at one side of the rotation axis of the cam sprocket and the second spring is disposed at another side of the rotation axis of the cam sprocket so that the first spring and the second spring interpose the rotation axis of the cam sprocket.

6. The variable valve mechanism according to claim 5, wherein the first link member and the second link member are disposed to be point-symmetrical to each other with respect to a center of the rotation axis of the cam sprocket and the first spring and the second spring are disposed to be point-symmetrical to each other with respect to the center of the rotation axis of the cam sprocket.

7. The variable valve mechanism according to claim 5, wherein in the first link member and the second link member, the weight portion is disposed at one side and the engagement portion is disposed at another side with respect to an imaginary line connecting the center of the swing shaft and the center of the rotation axis of the cam sprocket;

one end of the first spring is locked to a position near the weight portion in relation to the swing shaft of the first link member and another end of the first spring is locked to a position near the engagement portion in relation to the swing shaft of the second link member; and one end of the second spring is locked to a position near the weight portion in relation to the swing shaft of the second link member and another end of the second spring is locked to a position near the engagement portion in relation to the swing shaft of the first link member.

8. The variable valve mechanism according to claim 7, wherein a distance between a locking position of the first spring at the position near the weight portion in the first link member and the center of the swing shaft of the first link member is larger than a distance between the locking position of the first spring at the position near of the engagement portion in the second link member and the center of the swing shaft of the second link member; and a distance between a locking position of the second spring at the position near the weight portion in the second link member and the center of the swing shaft of the second link member is larger than a distance between the locking position of the second spring at the position near the engagement portion in the first link member and the center of the swing shaft of the first link member.

9. The variable valve mechanism according to claim 1, wherein in a non-swing state of the link member, an imaginary line connecting a center of the swing shaft to a center of the engagement pin intersects at a substantially right angle to an imaginary line connecting a center of a rotation axis of the cam shaft and the center of the engagement pin.

10. The variable valve mechanism according to claim 1, wherein a second stopper portion is provided in the inner wall surface disposed at a close side to the swing shaft in a vicinity of the second holding position, and the second stopper portion protrudes toward the inner wall surface facing the second stopper portion .

11. The variable valve mechanism according to claim 10, wherein the groove is provided with a substantially S-shaped moving line in which a center of the engagement pin in a front view bypasses the first stopper portion and the second stopper portion.

12. An engine comprising:

the variable valve mechanism according to claim 1.

13. An automatic two-wheeled vehicle comprising:

the engine according to claim 12.

* * * * *